US010479538B2

(12) United States Patent
Hu et al.

(10) Patent No.: US 10,479,538 B2
(45) Date of Patent: Nov. 19, 2019

(54) EXTERNAL VACUUM SEALER

(71) Applicant: Bigland Electric Applicance Co., Ltd., Dongguan (CN)

(72) Inventors: Zhihe Hu, Guangzhou (CN); Xinzhai Zheng, Dongguan (CN); Jiongxian Chen, Dongguan (CN)

(73) Assignee: BIGLAND ELECTRIC APPLIANCE CO., LTD., Dongguan (CN)

( * ) Notice: Subject to any disclaimer, the term of this patent is extended or adjusted under 35 U.S.C. 154(b) by 363 days.

(21) Appl. No.: 15/388,233

(22) Filed: Dec. 22, 2016

(65) Prior Publication Data

US 2018/0079538 A1 Mar. 22, 2018

(30) Foreign Application Priority Data

Sep. 21, 2016 (CN) ..... 2016 1 0837154

(51) Int. Cl.
*B65B 31/02* (2006.01)
*B65B 51/14* (2006.01)
*B65B 31/04* (2006.01)

(52) U.S. Cl.
CPC ..... *B65B 31/024* (2013.01); *B65B 31/048* (2013.01); *B65B 51/146* (2013.01)

(58) Field of Classification Search
CPC .... B65B 31/024; B65B 31/048; B65B 51/146
USPC ..... 53/512, 434, 474
See application file for complete search history.

(56) References Cited

U.S. PATENT DOCUMENTS 5,638,664 A * 6/1997 Levsen ..... B29C 66/0044 53/372.6
2006/0254220 A1* 11/2006 Patterson ..... B65B 31/046 53/434

FOREIGN PATENT DOCUMENTS

| | | |
|---|---|---|
| CN | 2564480 | 8/2003 |
| CN | 201580583 | 9/2010 |
| CN | 101033014 | 11/2010 |
| CN | 202557831 | 11/2012 |

* cited by examiner

*Primary Examiner* — Robert F Long
*Assistant Examiner* — Xavier A Madison
(74) *Attorney, Agent, or Firm* — Muncy, Geissler, Olds & Lowe, P.C.

(57) ABSTRACT

The present invention discloses an external vacuum sealer comprising a case, a heating adhesive strip, a heating band assembly and a lifting mechanism that all are installed in the case. The heating band assembly is set up underneath the heating adhesive strip, and is attached to the lifting mechanism. A plastic bag is disposed between the heating adhesive strip and the heating band assembly; the lifting device is able to drive the heating band assembly up such that the heating band assembly approaches the heating adhesive strip until the plastic bag is compressed and sealed; the lifting mechanism is also able to drive the heating band assembly down such that the heating band assembly can be far from the heating adhesive strip and the plastic bag. The lifting mechanism includes a pump unit that connects to the air pipe via the magnetic valve. The present invention enhances the production efficiency.

17 Claims, 6 Drawing Sheets

EXTERNAL VACUUM SEALER

CROSS REFERENCE TO RELATED APPLICATION

This application claims priority of Application No. 201610837154.5 filed in China on Sep. 21, 2016, under 35 U.S.C. § 119, the entire contents of which are hereby incorporated by reference.

TECHNICAL FIELD

The present invention relates to a field of vacuum sealing technique, in particular to an external vacuum sealer.

BACKGROUND

Vacuum sealer is being used widely in daily life, and there high demand on the number of consecutive use thereto.

Conventional vacuum sealer works in such manner that, an open end of plastic bag is placed between a heating band and a heat adhesive strip in the vacuum sealer, then compressed, vacuumed and sealed. However if the vacuum sealer is used consecutively for a long time, the heating band will have high temperature, causing the plastic bag being sealed before vacuumed whereby leading to a low-vacuum or non-vacuum therein.

One of the solutions to the above defect is to prolong an interval between two operations so as to cool the heating band, however it requires a long time to wait with inconvenience. Another solution is to use a fan blowing on the heating band, but this solution requires a complex structure and a little long time while the cooling effect is not good, with more costs and inconvenient use.

SUMMARY OF THE INVENTION

An aspect relates to an external vacuum sealer, wherein a heating band can be moved up or down, in order to control the heating band being closed to or far from the heat adhesive strip. The vacuum sealer ensures the vacuum of a plastic bag, and improves the production efficiency.

Embodiments of the present invention adopt the technical solution as follows:

An external vacuum sealer comprises a case, a heating adhesive strip, a heating band assembly and a lifting mechanism that all are installed in the case, wherein the heating band assembly is set up underneath the heating adhesive strip, and is attached to the lifting mechanism; a plastic bag is disposed between the heating adhesive strip and the heating band assembly; the lifting mechanism is able to drive the heating band assembly up such that the heating band assembly approaches the heating adhesive strip until the plastic bag is compressed and sealed; and the lifting mechanism is able to drive the heating band assembly down such that the heating band assembly can be far from the heating adhesive strip and the plastic bag.

The external vacuum further comprises a magnetic valve and an air pipe, the lifting mechanism comprises a pump unit that connects to the air pipe via the magnetic valve; the pump unit comprises a pump body, a piston and a conducting block; the piston goes through the pump body and extends out of an upper surface of the pump body; the conducting block is fixed on an upper end of the piston, and is connected to the heating band assembly; a bottom of the pump body is provided with an inner cap, and the piston goes through the inner cap.

The pump body is provided with a spring, the piston is sheathed by the spring.

An upper sealing ring is configured between the piston and the inner wall of the pump body.

The piston is provided with a slot, and the upper sealing ring is configured in the slot.

A lower sealing ring is provided at a portion where the piston is in contact with the inner cap.

The inner cap is sheathed by a piston sealing ring.

The piston is provided with a buckle above the upper surface of the pump body.

The piston is provided with an annular slot above the upper surface of the pump body, and the buckle is mounted in the annular slot.

The case comprises a side cover and a lid connected to the side cover.

The present invention provides a lifting mechanism which is able to drive the heating band assembly up and down, that is, when the plastic bag need to be sealed, the heating band assembly approaches the heating adhesive strip until the plastic bag is compressed and sealed; in the meantime, the heating band assembly can be far from the heating adhesive strip and the plastic bag, thereby the air is evacuated from the plastic bag completely. The present invention is able to avoid a problem that the plastic bag is sealed somewhere during vacuuming, due to the residual heat of the heating band assembly. Therefore, the present invention ensures airtightness of the plastic bag, and improves the production efficiency and quality.

DETAILED DESCRIPTION OF PREFERRED EMBODIMENTS

In order to facilitate the skilled person in the art understanding embodiment of the present invention, the invention will be further described with reference to the accompanying drawing.

Figure 1:
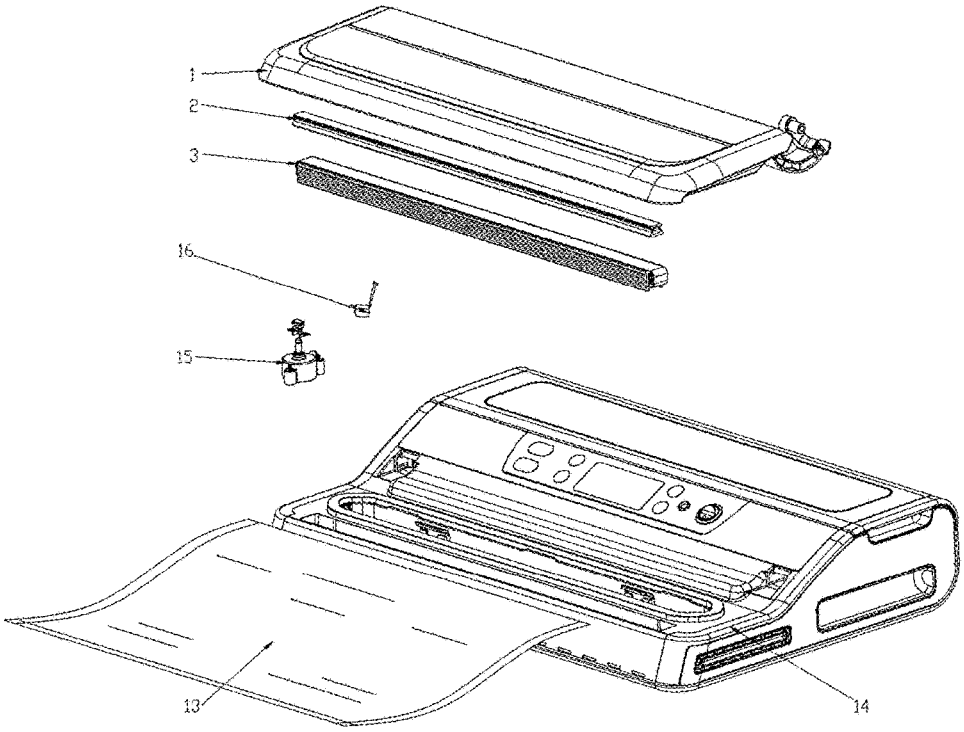
FIG. 1 is an exploded view of embodiment of the present invention.
Figure 2:
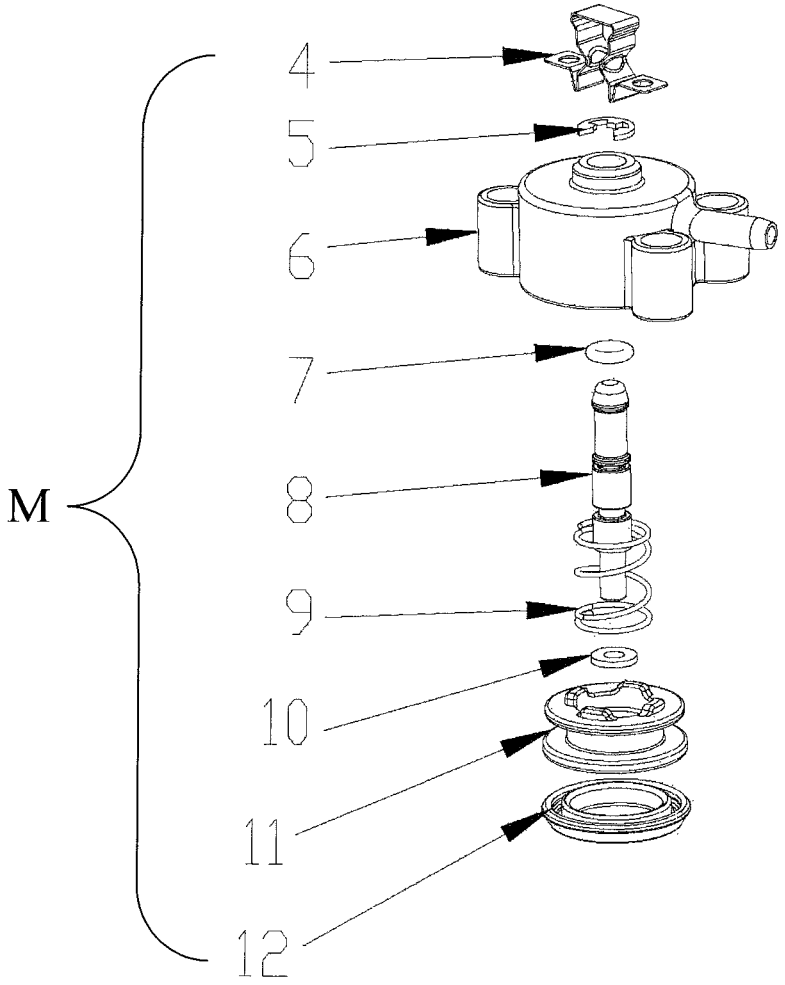
FIG. 2 is an exploded view of a lifting mechanism of embodiment of the present invention.
Figure 3:
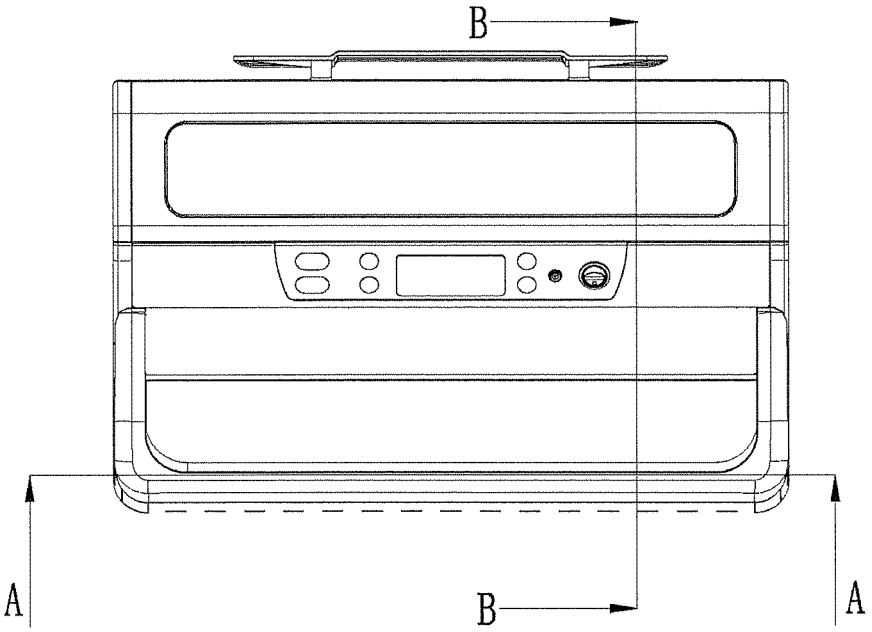
FIG. 3 is a top view of embodiment of the present invention.
Figure 4:
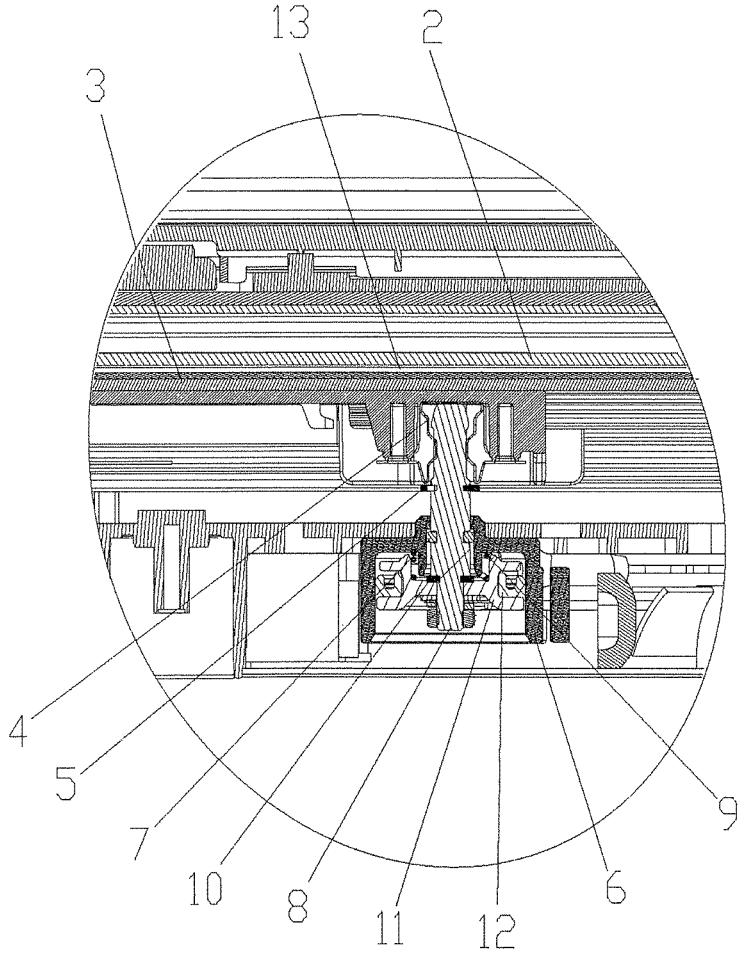
FIG. 4 is a sectional view along A-A line of FIG. 3 when a heating band assembly going up.
Figure 5:
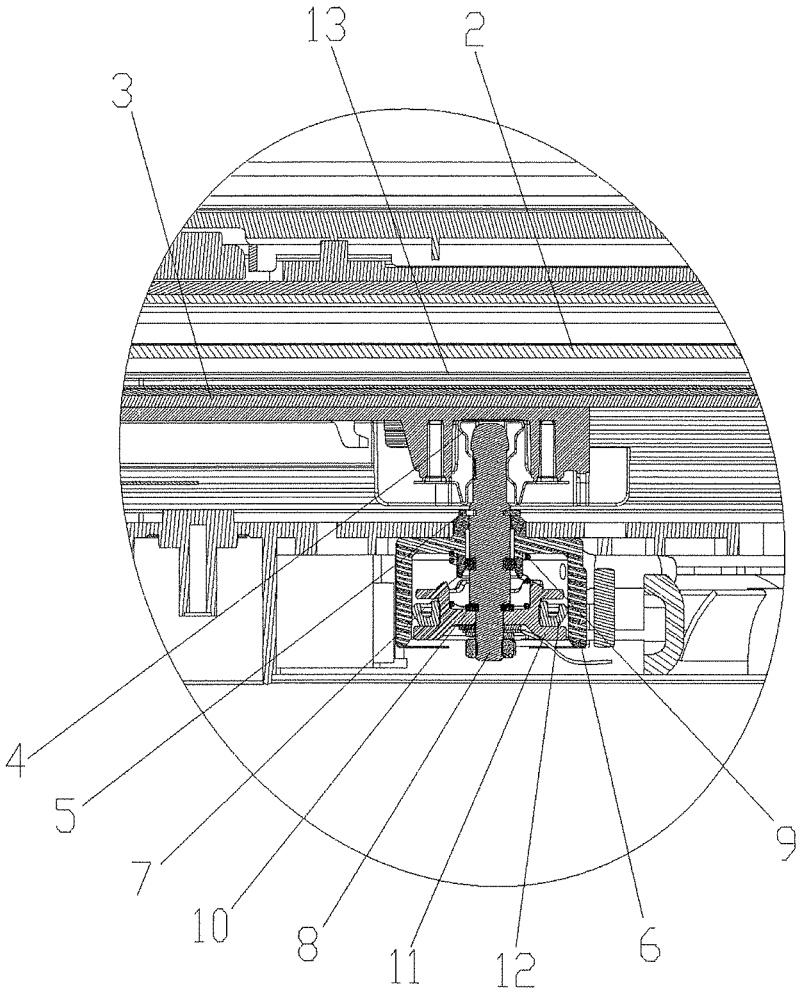
FIG. 5 is a sectional view along A-A line of FIG. 3 when the heating band assembly going down.
Figure 6:
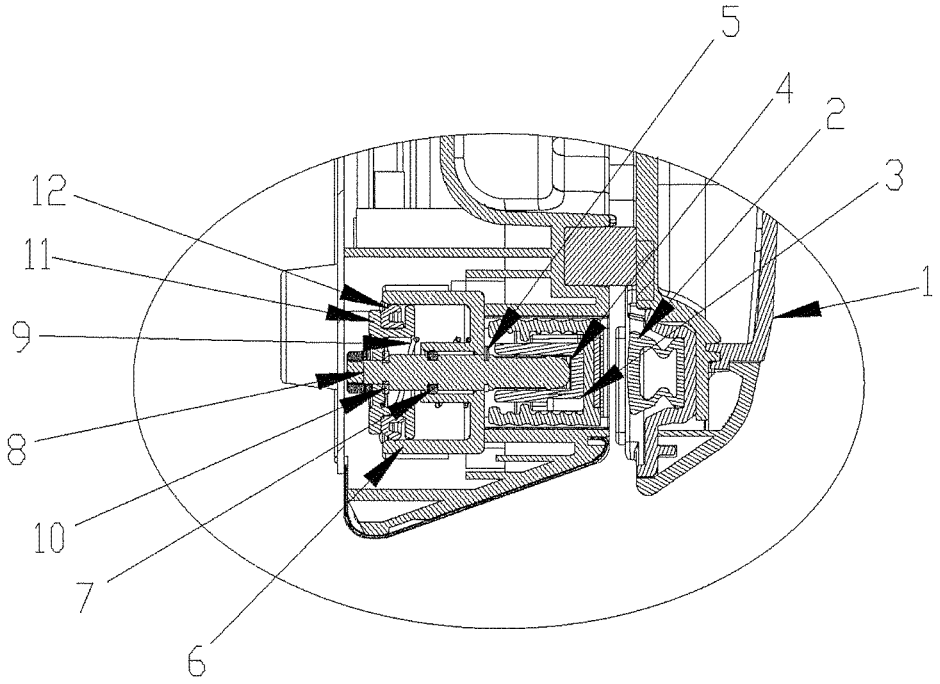
FIG. 6 is a sectional view along B-B line of FIG. 3.

As shown in FIG. 1-6, an external vacuum sealer, according to embodiment of the present invention, comprises a case, a heating adhesive strip 2, a heating band assembly 3 and a lifting mechanism M that all are installed in the case. The heating band assembly 3 is set up underneath the heating adhesive strip 2, and is attached to the lifting mechanism. A plastic bag 13 is disposed between the heating adhesive strip 2 and the heating band assembly 3. The lifting mechanism is able to drive the heating band assembly 3 up such that the heating band assembly 3 approaches the heating adhesive strip 2 until the plastic bag 13 is compressed and sealed. On the contrary, the lifting mechanism can also drives the heating band assembly 3 down such that the heating band assembly 3 will be far from the heating adhesive strip 2 and the plastic bag 13 can be released. When the plastic bag needs to be vacuumized, the lifting mechanism will drives the heating band assembly 3 down such that the heating band assembly 3 has no contact and no heating with the plastic bag, thereby the air is evacuated from the plastic bag completely, and the plastic bag has a high-vacuum.

The external vacuum sealer also comprises a magnetic valve 16 and an air pipe. The lifting mechanism comprises a pump unit 15 that connects to the air pipe via the magnetic valve 16. The pump unit 15 comprises a pump body 6, a piston 8 and a conducting block 4. The piston 8 goes through the pump body 6 and extends out of an upper surface of the pump body 6. The conducting block 4 is fixed on an upper end of the piston 8, and is connected to the heating band assembly 3. A bottom of the pump body 6 is provided with an inner cap 11, and the piston 8 goes through the inner cap 11. The pump body 6 is equipped with a spring 9 inside; The piston 8 is sheathed by the spring 9 whose one end is against the inner wall of the valve body 6, another end is against the inner cap 11. When the plastic bag 13 needs to be sealed, the piston 8 rises to push up the heating band assembly 3, whereby the inner cap 11 also moves up to compress the spring 9. After the heating band assembly 3 and the heating adhesive strip 2 have finished a seal for the plastic bag 13, the inner cap 11 will move down due to the resilience force of the spring 9, and drive the piston 8 down, while the heating band assembly 3 also move down together, this realizes the separation of the heating band assembly 3 and the plastic bag 13.

Further, an upper sealing ring 7 is configured between the piston 8 and the inner wall of the pump body 6. A slot is configured on the piston 8 to fix up the upper sealing ring so as to achieve a more reliable installation. A lower sealing ring 10 is configured at a portion where the piston 8 is in contact with the inner cap 11 so as to ensure that a dust is unable to enter the pump body from the gap between the piston 8 and the inner cap 11. The inner cap 11 is sheathed by a piston sealing ring 12.

An annular slot is configured at an upper end of the piston that protrudes from the pump body 6, a buckle 5 is set up on the annular slot. The buckle is preferably an E-type buckle.

Furthermore, the case comprises a side cover 14 and a lid 1 connected to the side cover 14, and the case covers all components.

The vacuum sealer can work in the following manner:

When the plastic bag needs to be vacuumized, the magnetic valve is switched off to close the air pipe, the inner cap moves down under the resilience force of the spring, whereby the piston and the heating band assembly move down simultaneously such that the heating band assembly will be far from the heating adhesive strip, thus the residual heat in the heating band assembly will not act on the plastic bag between the heating band assembly and the heating adhesive strip, and the air can be evacuated from the plastic bag completely. Then the magnetic valve will be switched on immediately so that the air pipe can be connected to the pump body, thereby the inner cap moves up under the force of air, and the piston moves up together to push the heating band assembly up to seal the plastic bag between the heating band assembly and the heating adhesive strip. At this moment, the spring will be compressed since the inner cap moves up. When the sealing finished, the magnetic valve is switched off to close the air pipe; the inner cap moves down under the resilience force of the spring, also bring the pump piston down, thereby the heating band assembly will move down, far from the heating adhesive strip, and are ready for next round work. Therefore, the present invention controls the heating band assembly up or down via the lifting mechanism, and realizes the contact or separation of the heating band assembly and the plastic bag, thereby, the vacuum and the airtightness of the plastic bag is ensured, and the production efficiency and quality is improved.

It must be understood that the above embodiment is not intended to limit the invention, and any obvious alternatives according to the present invention may be incorporated into scope of the present invention.

For the sake of clarity, it is to be understood that the use of 'a' or 'an' throughout this application does not exclude a plurality, and 'comprises' or 'comprising' does not exclude other steps or elements.

What is claimed is:

1. An external vacuum sealer comprising:

a case, a heating adhesive strip, a heating band assembly and a lifting mechanism that all are installed in the case, wherein the heating band assembly is set up underneath the heating adhesive strip, and is attached to the lifting mechanism; a plastic bag is disposed between the heating adhesive strip and the heating band assembly;

the lifting mechanism is able to drive the heating band assembly up such that the heating band assembly approaches the heating adhesive strip until the plastic bag is compressed and sealed;

the lifting mechanism is able to drive the heating band assembly down such that the heating band assembly can be far from the heating adhesive strip and the plastic bag; and a magnetic valve and an air pipe, the lifting mechanism comprises a pump unit that connects to the air pipe via the magnetic valve;

the pump unit comprises a pump body, a piston and a conducting block; the piston goes through the pump body and extends out of an upper surface of the pump body; the conducting block is fixed on an upper end of the piston, and is connected to the heating band assembly; a bottom of the pump body is provided with an inner cap, and the piston goes through the inner cap.

2. The external vacuum sealer of claim 1, wherein the pump body is provided with a spring, the piston is sheathed by the spring.

3. The external vacuum sealer of claim 2, wherein an upper sealing ring is configured between the piston and the inner wall of the pump body.

4. The external vacuum sealer of claim 3, wherein the piston is provided with a slot, and the upper sealing ring is configured in the slot.

5. The external vacuum sealer of claim 4, wherein a lower sealing ring is provided at a portion where the piston is in contact with the inner cap.

6. The external vacuum sealer of claim 5, wherein the inner cap is sheathed by a piston sealing ring.

7. The external vacuum sealer of claim 6, wherein the piston is provided with a buckle above the upper surface of the pump body.

8. The external vacuum sealer of claim 7, wherein the piston is provided with an annular slot above the upper surface of the pump body, and the buckle is mounted in the annular slot.

9. The external vacuum sealer of claim 1, where the case comprises a side cover and a lid connected to the side cover.

10. The external vacuum sealer of claim 1, where the case comprises a side cover and a lid connected to the side cover.

11. The external vacuum sealer of claim 2, where the case comprises a side cover and a lid connected to the side cover.

12. The external vacuum sealer of claim 3, where the case comprises a side cover and a lid connected to the side cover.

13. The external vacuum sealer of claim 4, where the case comprises a side cover and a lid connected to the side cover.

14. The external vacuum sealer of claim 5, where the case comprises a side cover and a lid connected to the side cover.

15. The external vacuum sealer of claim 6, where the case comprises a side cover and a lid connected to the side cover.

16. The external vacuum sealer of claim 7, where the case comprises a side cover and a lid connected to the side cover.

17. The external vacuum sealer of claim 8, where the case comprises a side cover and a lid connected to the side cover.

* * * * *